US005564141A

United States Patent [19]

Anderson

[11] Patent Number: 5,564,141

[45] Date of Patent: Oct. 15, 1996

[54] HYDRAULIC MATTRESS AND PLATFORM MATTRESS SUPPORT

[76] Inventor: Robert F. Anderson, 5300 13th St., Menominee, Mich. 49858

[21] Appl. No.: 338,234

[22] Filed: Nov. 14, 1994

[51] Int. Cl.[6] ..... A47C 27/08; A47C 27/10; A47C 27/14

[52] U.S. Cl. ..... 5/668; 5/678; 5/680

[58] Field of Search ..... 5/451, 455, 201, 5/400, 401, 470, 481, 917

[56] References Cited

U.S. PATENT DOCUMENTS

| | | | |
|---|---|---|---|
| 4,040,133 | 8/1977 | Gilreath | 5/451 |
| 4,389,741 | 6/1983 | Larson | 5/400 |
| 4,617,689 | 10/1986 | Nelson et al. | 5/400 |
| 4,757,564 | 7/1988 | Goodale | 5/451 |
| 4,768,251 | 9/1988 | Baskent | 5/468 |
| 4,901,383 | 2/1990 | Yang et al. | 5/400 |
| 4,970,743 | 11/1990 | Wride et al. | 5/451 |
| 4,991,244 | 2/1991 | Walker | 5/400 |
| 5,144,706 | 9/1992 | Walker | 5/201 |
| 5,245,716 | 9/1993 | Callaway et al. | 5/451 |
| 5,416,937 | 5/1995 | Johenning | 5/451 |

*Primary Examiner*—Steven N. Meyers
*Assistant Examiner*—Robert Santos
*Attorney, Agent, or Firm*—C. Kenneth Bjork

[57] ABSTRACT

The present invention comprises a multi-component mattress comprising a pillow top detachably connected to a mattress core. The mattress core comprises a plurality of hydraulic cylinders, liquid impervious covers for the cylinders, a variety of foam cushions positioned on top of the so-encased cylinders, a resilient edging holding the cylinders in place and defining the outer perimeter of the mattress core, a moisture barrier, and a cover encasing the core members. Upon assembly, water is added to the cylinders. A unique feature of this mattress is that it is manufactured and sold in knock-down, ready-to-assemble form. This provides for compactness in shipping, ease of handling, and a substantial reduction in consumer cost. The mattress is used in combination with a planar support platform which also is disclosed.

4 Claims, 4 Drawing Sheets

HYDRAULIC MATTRESS AND PLATFORM MATTRESS SUPPORT

SCOPE OF THE INVENTION

The present invention relates to a ready-to-assemble mattress and support platform base and more particularly is to a hydraulic mattress which is displaced laterally by body weight and to a planar support platform for supporting a mattress.

BACKGROUND OF THE INVENTION

Basically there are six types of mattresses, (1) innerspring, (2) foam, (3) air, (4) padded futon,(5) water-filled bladder, ie. waterbed, and (6) the hydraulic mattress of the present invention.

The first three types operate on the principle of compression whereby their surface is compressed by the body's weight to conform with the body's shape. Because such mattresses are designed to resist any compression caused by the body's weight and shape, during use uneven upward pressure of the mattress causes uncomfortable or even painful pressure points on the body. The more the body's weight compresses these mattresses, the more uneven the mattress pressure becomes on the body. Consequently, as the outermost portions of the body and the heavier portions press further down into the mattress, these segments of the mattress become more compressed than others with resultant uneven, uncomfortable, even painful pressure. Because compression mattresses begin to impact on joints and other exterior body segments after a person fails asleep, there is no conscious awareness of this discomfort and, as a result, the body continually changes sleeping positions many times during the sleep period. It is only the multiple changes of sleep positions that makes it possible to endure lying on a compression type mattress for an extended period of time. However, the constant movement during sleep substantially reduces the quality of sleep.

More recently waterbeds have been developed which operate on the principle of displacement. Their principle of operation reduces uncomfortable and painful pressure points. Also, waterbed mattresses are easy to wipe clean and sanitize, unlike the compression mattresses discussed hereinbefore.

For those familiar with waterbed art, it is evident these also have a number of disadvantages. For example, traditional waterbeds are quite heavy and many bedroom floors cannot safely support their weight. They also provide little or no protection from punctures by sharp objects which can result in damaging leaks. The waterbed mattress also produces a wave action whenever a person enters or exits the bed or simply changes sleeping positions. This wave action can interrupt sleep and/or lead to motion sickness. Draining, disassembling, assembling, and moving a heavy waterbed is a major undertaking, usually requiring specialized waterbed movers.

In order for a waterbed mattress to maintain its shape while in use, it generally is contained in a solid frame, usually of wood, which makes it difficult and even painful to get into, or out, of the bed.

Conventional waterbeds require heaters which are expensive to purchase and operate, and to replace or repair, usually requires the lengthy process of draining the mattress. Also, scientists have questioned the safety of the magnetic field resulting from the waterbed heater being positioned under the body. For dual use, achieving a temperature setting comfortable to both persons is a problem.

With conventional bladder type full-depth water-filled mattresses, a condition known as hammocking occurs that causes a curvature in the alignment of the body's spinal column while sleeping, which can result in back problems. Additionally, making up a waterbed is difficult.

The problems associated with conventional compression mattresses and the difficulties encountered with conventional waterbed mattresses are eliminated and overcome by the mattress of the present invention which functions on the principle of hydraulics and fluid displacement.

It is a principal object of the present invention to provide a mattress where uneven, upward presure is reduced through displacement and horizontal movement of hydraulic fluid which directs downward pressure from a body's weight horizontally away from the body, thereby substantially reducing discomfort and painful pressure points due to concentrated upward pressure.

It is another object of the present invention to provide a mattress which is firm enough to maintain straight spinal alignment in all sleeping positions while still being sufficiently resilient to provide a uniformly comfortable and healthful night's rest regardless of the body's weight or shape.

It is a further object of the present invention to provide a ready-to-assemble mattress comprised of multiple components that permit simple break down to facilitate moving, transporting, assembling and disassembling, and also replacing damaged or worn parts, thus eliminating the environmental problem of disposing of conventional compression type mattresses.

It is also an object of the present invention to provide a hydraulic mattress which readily can be routinely cleaned and sanitized having a replaceable, reversible pillow top cover.

It is another object of the present invention to provide a mattress which is manufactured in knock-down kit form which has the advantage of compact packaging for shipping and handling, but which also can be readily assembled by the consumer.

These and other objects and advantages of the present invention will become readily apparent from the following detailed description when read in conjunction with the drawings.

SUMMARY OF THE INVENTION

The mattress of the present invention comprises a detachable top cover, hereinafter referred to at times as the pillow top, which is the surface contacted when in use and a multi-component matrix or core which is the basic foundation unit of the present hydraulic mattress.

The core comprises a plurality of resilient elongated members, hereinafter referred to generically as cylinders. The elongated members have a top containing a fill spout and closed or sealed bottom. The length of a cylinder is substantially that of the length of the mattress. In the core, they are positioned in side by side array, the number used being predetermined to substantially define the width of the mattress. The cylinders are encased or otherwise covered or contained by liquid impervious casings and liners. The array of cylinders is held in position by firm, resilient foam border edges which define the perimeter of the core. A foam cushion is positioned on top of the array of cylinders. This combination of core elements is encased in a cover.

The mattress can be supported by a variety of frames or supports. Because of its a unique construction, the mattress is generally used in combination with a planar support platform which will be described in detail hereinafter.

The pillow top which extends substantially over the top of the core assembly is composed of fabric top and bottom sheet-like members and a center polymeric or natural fiber or other batting filler. The pillow top is fitted with fastening means mating with the same on the top of the mattress core cover which provide for attaching and separating these from each other to facilitate ready removal of the pillow top for cleaning, reversing, or changing. Snaps, zippers, Velcro® straps or other detachable and re-attachable fastening means can be used. The filler and cover sheets usually are of washable materials for ease in cleaning, although dry cleanable fabric materials can be used for the pillow top if desired. Conveniently, the top and bottom sheet-like covers can be the same or of different materials and patterns. Since the pillow top is reversible, this gives an increased life-span and greater flexibility of use.

The center filler which serves as a cushion in the pillow top can be varied in density and thickness to provide a variety of predetermined degrees of softness or firmness. As is understood by one skilled in the art, quilting or otherwise securing the filler to the sheet-like covering members will keep the filler in place and eliminate bunching or separation during use.

The multi-component matrix or core of the mattress comprises a border of high density, firm edge members essentially the overall height of the core. These generally range from about 7 to about 18 cm. (3 to about 7 in.) in thickness and are of a density and firmness to contain the cylinders as well as give adequate support to hold a person sitting on the edge of the mattress or an object placed near the mattress edge. The edge members are not hard like a wood frame, but are slightly non-permanently deformable with a memory to return to their original shape when weight or pressure is removed.

Ordinarily, these mattress core wall supports are encased in a fabric sleeve to reduce friction and abrasion of the wall members. The sleeve can contain an integral pocket extending outwardly from its bottom inside edge which is designed to hold a thin, rigid planar member. This serves as a stop or barrier against migration of the hydraulic cylinders which during use, without such a barrier, might distend and migrate under the foam side walls. For ease in fitting the foam side-wall members into the sleeves and for replacement, the sleeves can be fitted with zippers, snaps or other connecting means.

In another embodiment, a single length of flexible, non-stretch material is wrapped around both side rails and fastened to itself in such a manner as to permit the now connected side rails to be spaced apart a precise, predetermined distance across the mattress cavity with the connecting material passing under the hydraulic cylinders. The two end rails are similarly connected with the connecting material also passing under the hydraulic cylinders, but at a right angle to the side rails. The connecting of the side and end rails to their counterpart serves to prevent the side rails from bowing outwardly due to hydraulic pressure from the deformation of the cylinders, and also serves to hold the hydraulic a cylinders in their proper position by preventing the migration under the side and end rails of the hydraulic cylinders.

A flexible, but shaped fluid-impervious safety liner of the same shape as the cavity resulting by the assembly of the foam edge sidewalls is fitted within these sidewalls. This liner extends throughout the interior defined by the sidewalls with the liner walls being the height of the hydraulic cylinders of the core. The liner contains an inwardly projecting flange at its top around the four sidewalls. The flange prevents the liner from slipping down when the cylinders flex during use. In addition to holding the cylinders in place, this liner serves as a secondary safety source to hold and prevent any liquid that might leak from a cylinder and cause damage.

A plurality of hydraulic cylinders about half the height of the mattress core generally ranging in cross-section from rectangular with rounded edges to elliptical in shape are placed side by side within the secondary liner across the width of the cavity between the sidewalls. These cylinders extend the length of the cavity. The number used will vary depending on the mattress size and degree of firmness desired. In width, each cylinder will range from about 15 to about 26 centimeters. They are fabricated from a flexible rubber or polymeric material. Water or other suitable hydraulic fluid is added in predetermined quantities to each cylinder to provide a desired firmness. The amount of fluid can be changed to adjust the firmness.

A particular advantage of the hydraulic mattress of the present invention is the ease of filling. Because of the easy to handle size and shape of individual cylinders, a cylinder can be placed on end and water added to a predetermined marking on the cylinder. Also, the member can be placed on a conventional scale and the amount of liquid used determined by the weight of the cylinder. Since the cylinders are uniform in cross-section, charts showing the amount of liquid needed to achieve a predetermined firmness for a given set of cylinders can be made, thereby further aiding in preparing the mattress for use.

Each cylinder is placed into an individual, flexible, liquid-impervious tube which serves as a primary safety liner against leakage. This tube is longer than the length of the cylinder and, as assembled, is folded over the top of the cylinder at each end, and thereby prevents leakage. Adhesives or other sealants can be used to seal the ends of the liner tubes if additional precautionary measures against leaks are desired. However, in practice, this has not been found to be necessary. These primary liners prevent fluid, which might leak from a cylinder, from spreading throughout the secondary liner. Further, by constructing the hydraulic cylinders from an opaque material and the tubular primary liners from a clear material, it would be easy to identify a cylinder from which liquid might be leaking. Additionally, if the liquid hydraulic fluid is colored in some way, such identification becomes even easier.

If desired, a thin flexible liner in the form of an inverted tray can be placed over the secondary liner with its edges extending downwardly between the side of the secondary liner and the sleeve member covering the side walls. This provides still further assurance that any leakage which may occur through the top of a hydraulic cylinder would not wick up into the porous foam cushion positioned on top of the cylinders.

Alternatively, the foam cushion members can be placed in a thin, liquid-impervious liner having sidewalls and a short, inwardly-projecting flange-like top edge. Such a holder also gives the added advantage of keeping the foam cushion members in place.

Although, as set forth in this specification, the hydraulic mattress of the present invention is fitted with a number of safeguards to prevent the spread of liquid exuding from the cylinders, it is essential to know that the probability of leaks or fluid loss from cylinders loaded with liquid in accordance with predetermined standards is very minimal. This is a further advantage of the present invention over conventional bladder-type water beds.

The foam cushion which fits between the cylinder assembly and the pillow top of the mattress can be one piece in construction. However, for greatest control of mattress firmness and meeting various individual needs and desires, constructing this cushion from a plurality of foam sections of different densities and surface configurations is preferred. To illustrate, by using foams of different firmness on each half width of the mattress, the needs of two different individuals can be met. Also, by using a plurality of components from the top to the bottom of the mattress to meet the varying pressures exerted by the upper and lower portions of the body as well as the torso, considerable versatility and individualized comfort is achieved.

As a practical approach, it has been found that either 3 or 6 components work well for this cushion. With three members, each extends across the full width of the mattress and in width is about one-third of the mattress cavity length. A preferred configuration is to use foam segments having a convoluted upper surface for positioning on the upper surface near the top and bottom ends of the mattress core and a firmer, smooth-surfaced segment for the middle member which supports the greatest portion of the body's weight. Using this same configuration for the six member cushion, each segment would extend only one half of the way across the width of the mattress providing for further density and firmness control for each half of the mattress.

The core assembly is encased in a cover, usually of fabric. This cover can be varied to give a number of alternative modifications to the mattress core unit.

In one form, the cover can be a zippered case enclosing all the core components and having connectors or fasteners on its top surface mating with those on the pillow top thus providing for reversing or replacing the top. In this configuration, the cover top and side walls can be of a material and construction to permit the cover to stretch and recede during a use while the bottom can be of a non-stretchable material which further aids in maintaining the mattress shape.

In a second embodiment, the mattress cover top is eliminated and the pillow top rests directly on the foam cushion. The pillow top in this modification contains a border which extends over and down the outer side walls of the mattress core and is connected, as by a zipper, to the bottom or lower sidewall edge of the mattress cover.

If desired, an additional sheet-like moisture barrier can be placed between the pillow top and the foam cushion to serve as a barrier preventing perspiration, liquid spills and the like from seeping through the pillow top and reaching the foam cushion members.

The platform is a rigid planar member of sufficient compression and tensile strength to support this mattress core. Ordinarily, it is made of wood, such as plywood sheeting or particle board, for example. For ease in shipping, handling, assembling and disassembling, preferably it is constructed in a plurality of segments detachably joined together. Conveniently, two segments, each about one-half of the length of a mattress and about the width of a mattress, or four segments, each about one-quarter of the surface area of a mattress, can be used. It can contain a raised edge around its perimeter, extending part way up the height of the mattress core to maintain the shape of the mattress.

The three components can be used together as a unit with the platform support being placed onto a bed frame. This mattress unit works very well with the bed frame assembly disclosed in U.S. Pat. No. 5,099,529, or that shown in my pending design application, Ser. No. 29/025,708. A particular advantage of the present invention is that no spring support is needed.

BRIEF DESCRIPTION OF THE DRAWINGS

In the detailed description of the preferred embodiments of the invention presented hereinafter, reference is made to the accompanying drawing in which.

DETAILED DESCRIPTION OF THE DRAWINGS

Figure 1:
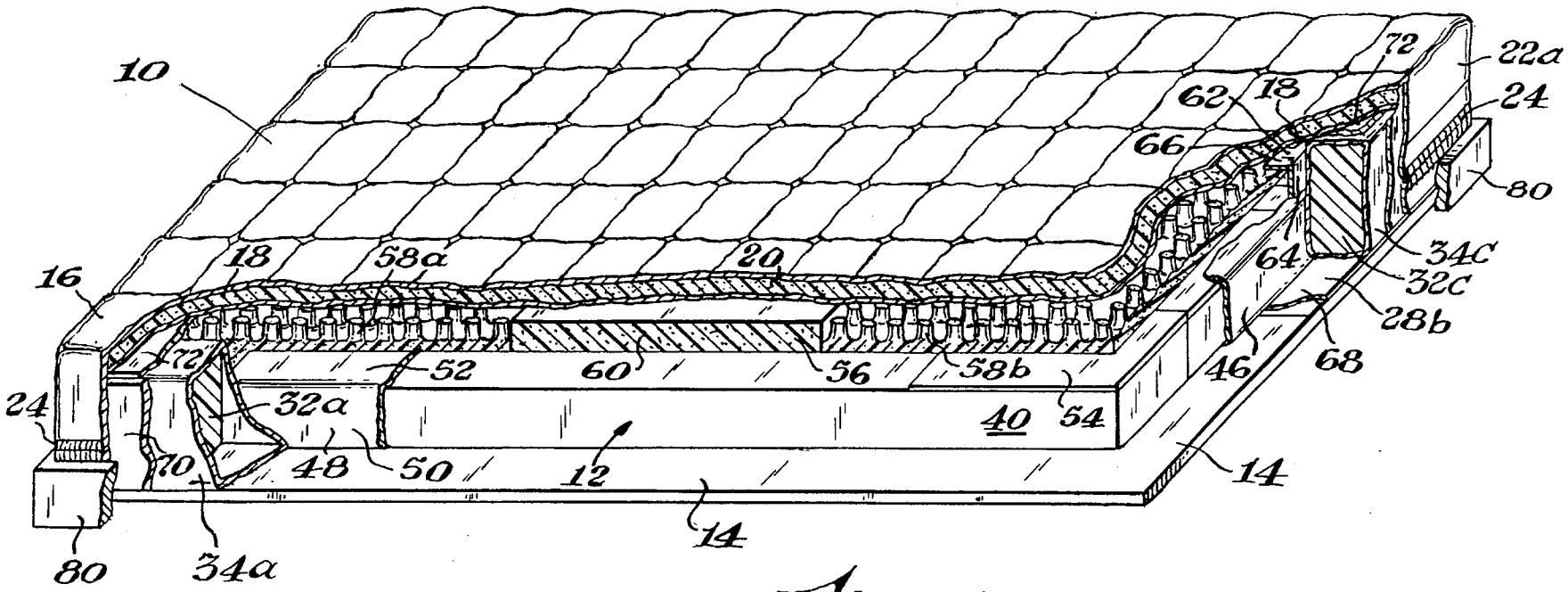
FIG. 1 is a perspective view of a hydraulic mattress and a platform support with portions broken away to reveal one preferred embodiment of the pillow top, mattress core and support platform.

Reference is made first to FIG. 1 which shows a preferred embodiment of the combination of pillow top 10, mattress core 12, foam cushion 56, and mattress cover **28*a*, along with a support platform 14**.

Pillow top 10, which provides the sleeping surface, is comprised of a top fabric, sheet-like component 16, a bottom sheet cover 18 and polymeric or natural fiber filler 20. Conveniently, to assure the filler or batting 20 remains fixed within the cloth covering layers 16 and 18, the pillow top 10 is quilted (as shown), tufted or otherwise sewed or finished as is practiced in the quilting art. In this embodiment, the top 10 has a border **22*a* around its perimeter which extends downwardly over the sides of the mattress core 12 and contains one:half of a zipper 24 which mates with a second half in mattress cover 28*b*** as will be discussed in detail hereinafter.

Figure 6:
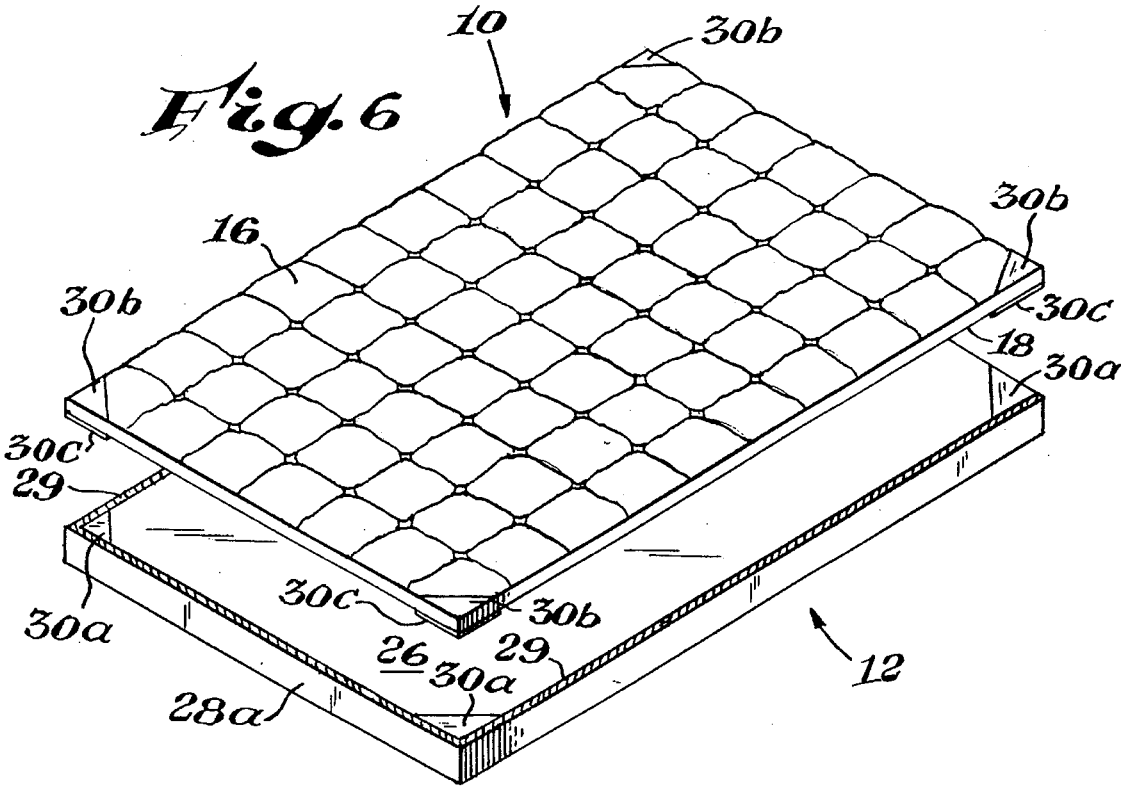
FIG. 6 is an exploded perspective view of the pillow cushion and mattress core showing one preferred embodiment for fastening these components together.

In another embodiment of the pillow top 10, as depicted in FIG. 6, the top 10 does not contain border **22*a* but is designed to be of the same size and configuration as the top of the mattress core 12. In this embodiment, the top 26 of the mattress cover 28*a* employed to contain the various components comprising the core 12 is integral to the cover and fitted with a zipper 29 on three sides. It contains a Velcro® patch 30***a*, or diagonal strap (not shown) in each corner. These mate with similar patches 30*b* in each corner of the top cover 16 of pillow top 10 and 30*c* in each corner of the bottom cover 18. By having fasteners 30*b* and 30*c* on both sides of the pillow top 10, this becomes reversible, giving increased flexibility and extended life. The covers 16 and 18 can be identical or of different fabrics and designs thus further extending the versatility and flexibility. Materials used in the pillow top 10 preferably are either washable or dry-cleanable. The ready detachment and re-attachment of the top 10 to the core 12 makes changing, reversing, and cleaning an easy task.

Figure 5:
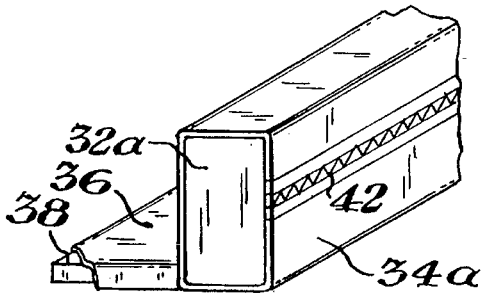
FIG. 5 is a fragmentary perspective end view of another preferred embodiment of a side rail construction of the mattress core.

The mattress core 12 of the preferred embodiment of FIG. 1 comprises a perimeter of high density, substantially rectangular side edges 32*a* and 32*b* and head and foot edges 32*c* and 32*d*. These are of a height about equal to that of the height of the completed core 12. Each of these is encased in a fabric sleeve 34*a*–34*d*. The sleeves 34*a*–34*b* of the side edges 32*a*–32*b* and end edges 34*c*–*d* each have an integral pocket 36 extending outwardly from its lower inside edge. As shown in greater detail in FIG. 5 the pocket 36 holds a rigid planar member 38 which serves as a barrier against migration of the hydraulic cylinders 40 under the bottom of the edge members 32*a*–32*d*. Also, as shown in FIG. 5, each sleeve eg. 34*a* is fitted with a zipper 42 to provide for ready placement of the edges 32*a*–*d* in their respective sleeves 34*a*–*d*.

Figure 2:
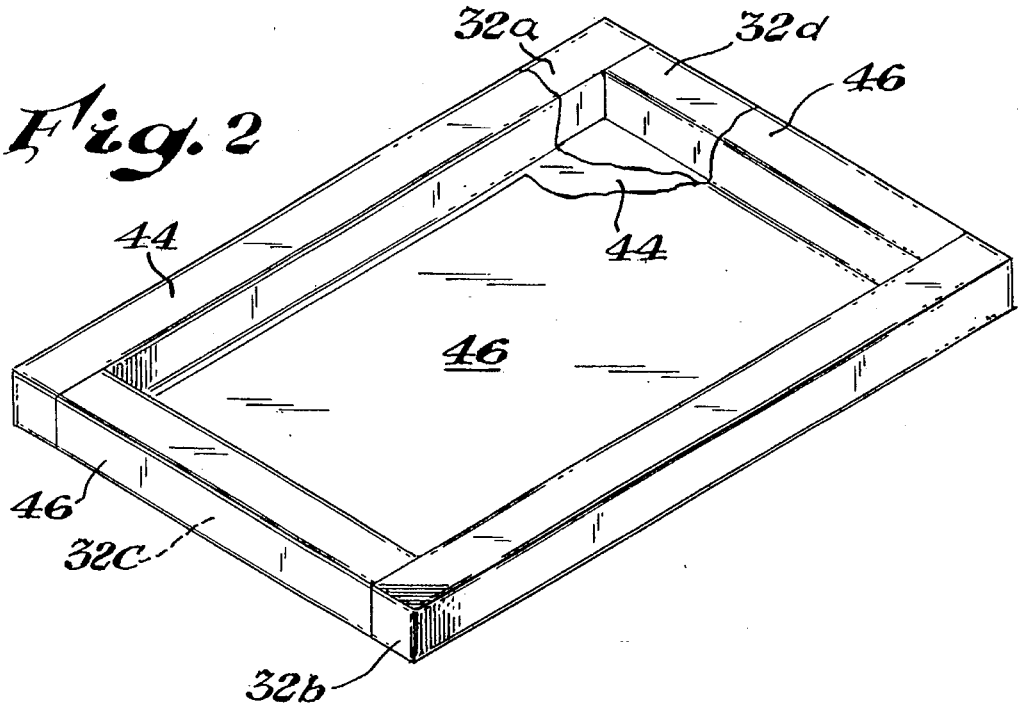
FIG. 2 is a top front view in perspective of a portion of the mattress core with elements deleted to reveal a preferred embodiment of the spacing cover for the foam side rails and end rails.
Figure 3:
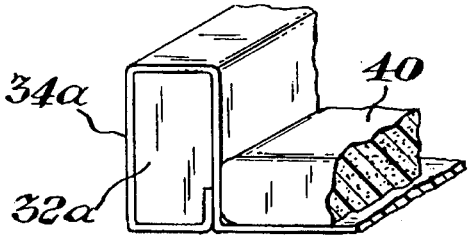
FIG. 3 is a fragmentary perspective end view of one foam rail showing in detail the cover construction depicted in FIG. 2.

In another preferred embodiment as shown in FIG. 2 and FIG. 3, the two side rails 32*a*–32*b* are joined by a flexible, non-stretchable sheet 44 which encases rails 32*a*–32*b* and is bonded to itself at the lower inner corner of the side rails 32*a*–32*b*. Hot melting or adhesives have been found to be a satisfactory way to bond the ends of sheet 44 to itself. The sheet 44 between the rails 32*a*–32*b* has a sufficient length to provide a predetermined mattress width between the inner faces of rails 32*a*–32*b*. In the same manner, a second sheet 46 encases end rails 32*c*–32*d* and is placed at a 90 degree angle to sheet 44 across the cavity defined by the distances between the inner faces of end rails 32*a*–32*b*. This sheet in length is that of the distance between these edges 32*c*–32*d* which is about the length of cylinders 40. The resulting configuration is such that a right angle (90 degrees) corner is formed between the bottom edge of the inner faces of rails 32*a*–32*d* and the bottom sheets 44 and 46.

A flexible, but shape-retaining fluid-impervious safety liner 48 of the same shape as the cavity defined by the configuration of the edges 32*a*–32*d* is fitted within the cavity. This liner 48 has raised sidewalls 50 and an inwardly projecting flange 52 at its upper edge around all four sides. The height of sidewall 50 is such that the cylinders 40 fit comfortably therein.

A plurality of cylinders 40 are placed within liner 48, across the width of said liner 48. Each of these in length is substantially the length of the distance between the inner faces of the rails 32*c*–*d* minus the thickness of sleeves 34*c*–*d* and/or sheet 46 and liner 48. In cross-section, they usually are rectangular with rounded edges or elliptical. For rectangular cylinders, the height ranges from about 7 to 20 centimeters and width from about 18 to 26 centimeters, with these same distances being applied to the axis if the elliptical cross-sectional shape is used. The nature and composition of these cylinders and mode of placing measured amounts of liquid therein have been described in detail hereinbefore.

Each cylinder 40 is placed into a flexible, liquid-impervious tube 54 of the same a cross-section as said cylinder 40. The tube 54 is longer than cylinder 40 and has each end folded up and over the top of the cylinder 40.

The foam cushion 56 as depicted in the preferred embodiment of FIG. 1 consists of two flexible foam convoluted sections 58*a*–58*b* and a smooth surfaced flexible segment 60. As discussed hereinbefore, the cushion 56 can be configured in a variety of ways to provide a surface of different densities and hardness.

As shown, the cushion members 58*a*–*b* and 60 rest in a liquid-impervious tray 62 with raised side walls 64 and inwardly projecting flange 66 at its upper edge. The overall length and width of the tray is such that it fits comfortably within the edge members 32*a*–32*d*.

Figure 4:
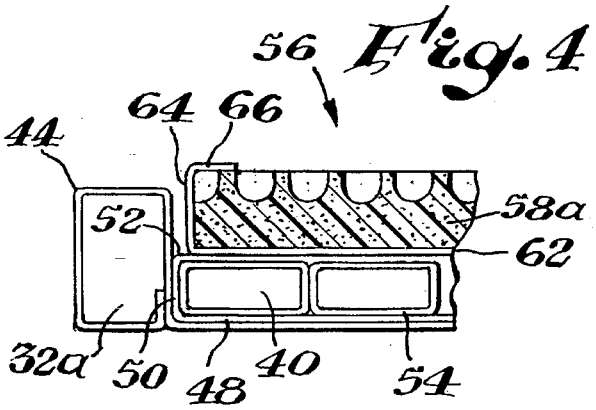
FIG. 4 is a fragmentary end view of the mattress core showing in detail the liquid-impervious liners used in a preferred embodiment to hold and protect the core components.

FIG. 4 shows in greater detail the combination of liners and liquid-impervious barriers utilized in this preferred embodiment of the mattress core. As shown in FIG. 4 the height of the cylinders 40, cushion 56 and liners and trays in the core 12 is slightly higher than that of the rails 32*a*–32*d*.

Figure 7:
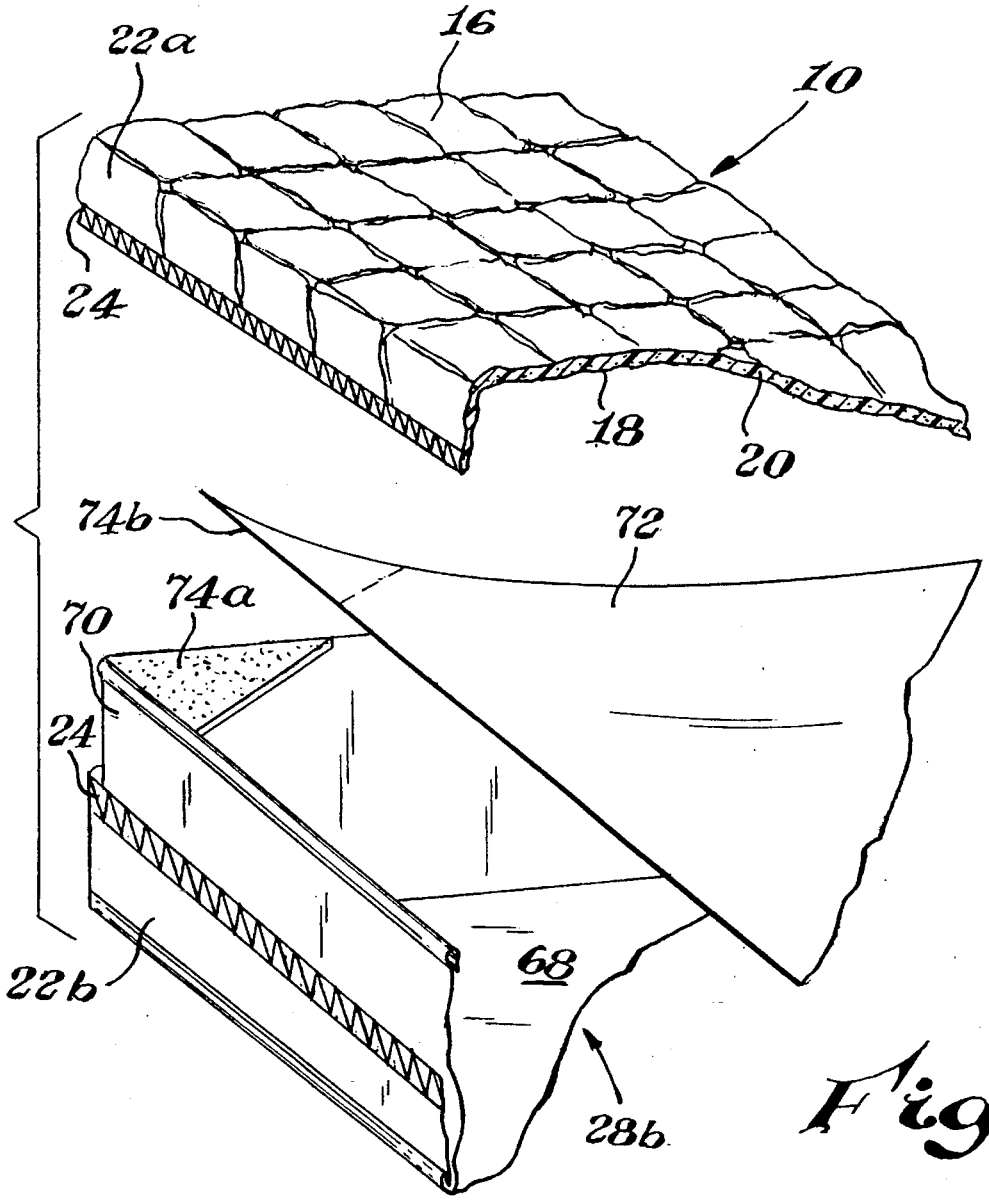
FIG. 7 is a fragmentary perspective view of a preferred embodiment of mattress cover and moisture barrier.

The core assembly described directly hereinbefore is encased in a cover 28*b*. In the a depicted preferred embodiment shown in FIG. 1 and fragmentary view of FIG. 7 the cover 28*b* comprises a bottom 68 and side walls 70 of a substantially non-stretchable material, the side walls 70 extending upwardly to the height of the core 12. A unique feature of this embodiment is the inclusion of a thin moisture-proof sheet 72 as a top. The four upper corners of the sidewalls 70 each contain a Velcro® pad 74*a* mating with similar corner pads 74*b*on the bottom of top member 72. The sidewalls 70 of the mattress core cover 28*b* near or at its lower edges have fastened thereto a strip of border 22*b* containing the mating half of zipper 24 attached to a border 22*a* of pillow top 10.

The mattress core 12 and pillow top 10 combination of the present invention generally are supported by a planar platform support.

Figure 8:
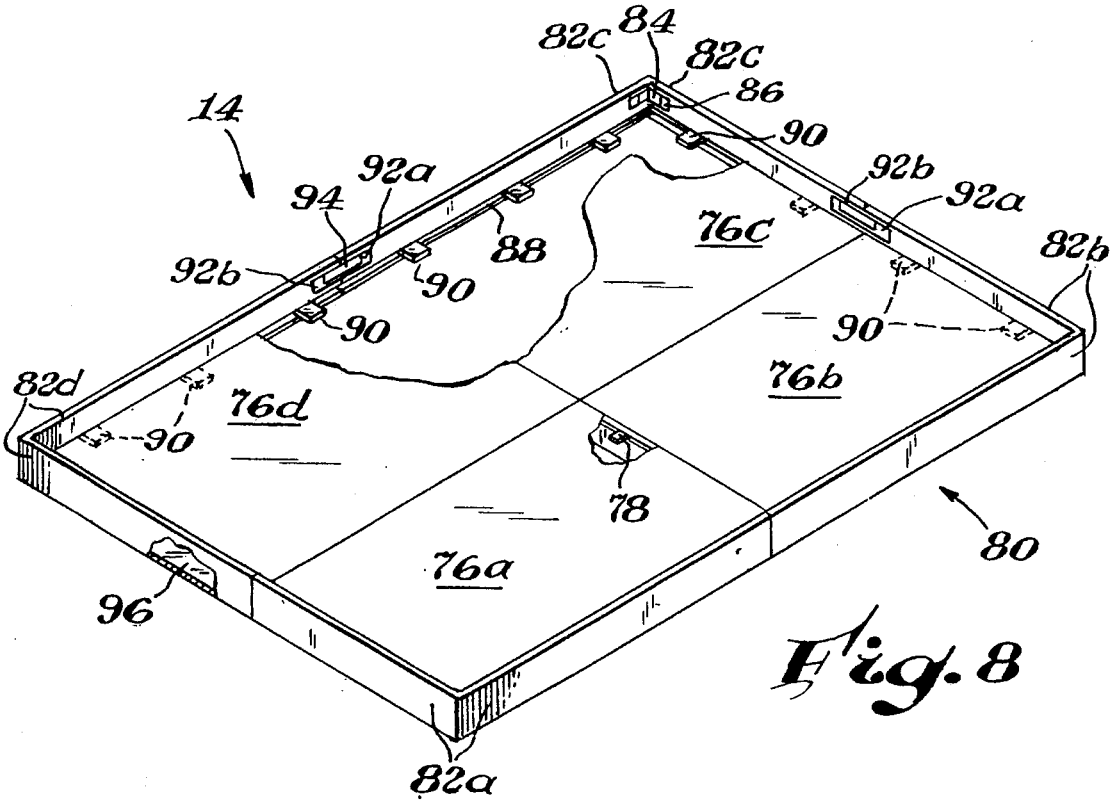
FIG. 8 is a perspective end view of a support platform with portions broken away to reveal a preferred embodiment of its construction.

One preferred embodiment of a platform support 14 is depicted in FIG. 8. As shown in FIG. 8, the bottom support is generally rectangular in shape and comprised of four planar substantially identical sections 76*a*–76*d*. Each of the sections 76*a*–76*d* is about one-half of both the width and length of the platform 14, ie. is equivalent in size to be one-quarter of the platform 14. The members 76*a*–76*d* are pre-sized and cut to provide a support 14 of predetermined size to accommodate a twin, regular, queen or king size hydraulic, air, waterbed or conventional box spring and mattress. Two of the members 76*a*–76*d* are positioned adjacent members 76*b*–76*c* such that they abut each other. In the assembled platform 14, the segments 76*a*–76*b* and 76*c*–76*d* are fastened together along their mating edges, extending widthwise across their junction, by plates 78 screwed or otherwise affixed to the underside of the adjacent segments. As shown in the cut-away view of FIG. 8, only one plate 78 is shown for each of two members. However, in practice, a plurality of plates is generally used, although this is not critical. One of the plates 78 connecting each two segments 76*a*–76*b* and 76*c*–76*d* is sufficient.

Preferably, the outer corner edges of the joined segments will be cut at an angle, if no edge member is to be used, so as to match the generally rounded corners of a mattress and eliminate potentially hazardous sharp 90-degree corners on the platform 14. This is not necessary in the depicted embodiment if the base support 14 is used in conjunction with a raised edge assembly 80 extending around the perimeter of platform 14. The edge assembly 80 comprises four pairs of two-armed members 82*a*, 82*b*, 82*c* and 82*d*. These pairs each are joined at one end by a corner hinge 84 which fits into shallow grooves 86 in the adjacent ends of the arms. To provide a 90-degree angle corner when the pairs 82*a–d* are opened and fitted to platform 14, the ends of each member of the pair are cut at a 45-degree angle. The arms of each pair 82*a*–82*d* are of a length such that they extend half of the distance along two adjacent sides of platform 14. Each of the pairs of arms 82*a*–82*d* contains a shallow groove 88 near the bottom of each component which runs the entire length of the member. These grooves 88 are of a size to slidably engage the edges of platform 14. A plurality of L-shaped angle brackets 90 having one arm fitted into groove 88 are firmly attached to the arm sets 82*a*–82*d* by a screw. After the platform 14 is fitted into the groove 88, it is fastened in place by a screw passing through the opposite arm of the bracket 90 and into the platform 14. The ends of the edge pairs 82*a*–82*d* opposite hinge 84 each contain a shallow groove 92*a*–92*b* positioned to align these ends of the arms of two adjacent pairs 82*a*–82*d*. These shallow grooves 92*a*–92*b* are of a width and shape to accommodate a strap connector 94 extending from the adjacent pairs of arms 82*a*–82*d*. Again, screws a are used to hold the strap connector 94 in place. The groove 88 should be of a depth such that the screw heads holding connector plate 94 do not project out far enough to catch bedding when it is tucked between the edging 80 and the mattress core 12. The height of the edges 80 need only be sufficient to hold a mattress in position when placed on the platform 14. Generally, the height of the raised edge assembly 80 extending above the platform 14 will be from about one-fourth to about three-fourths of the height of a mattress.

Figure 9:
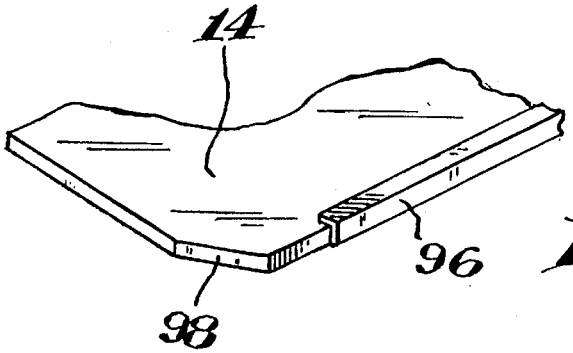
FIG. 9 is a fragmentary perspective view of a preferred embodiment of a support platform, showing a shaped edge channel and trimmed corner.

In one preferred embodiment, as shown in FIG. 9, in place of the edge assembly 80, smooth surfaced substantially ⊔ shaped channel members 96 are fitted onto the edges of the platform 14 to give a smooth outer edge surface around its perimeter. The ⊔ shaped channel members 96 usually are formed by extruding, stamping, forging, etc. from a polymer or metal and are of a size to provide a frictional fit when pushed with slight pressure onto the outer edge of platform 14. Also, as shown in FIG. 9, the corners 98 of platform 14 are rounded or cut at 45 degrees to match the radius of the mattress corners.

The platform segments 76*a*–76*d* can be constructed from plywood, shipboard, strand board or other particle boards, rigid polymer or other planar construction materials. For ease of construction, favorable economics and a high strength-to-weight a ratio, strand or particle board has been found to be quite satisfactory.

Various modifications can be made to the present invention without departing from the spirit or scope thereof as will be understood by those skilled in the art.

I claim:

1. A hydraulic mattress comprising in combination:

a) a multi-component core foundation unit consisting of a perimeter of two high-density foam rectangular side rails and two high-density foam rectangular end rails, each of said side rails and end rails being non-permanently deformable under application of weight or pressure, each of said side and end rails being of a height defining the height of the core foundation unit, a flexible, non-stretchable sheet extending between the side rails, the ends of said sheet each encasing one of said side rails and having its edges bonded to the sheet at the lower inner edge of each of said side rails, a second flexible, non-stretchable sheet extending between the end rails, the ends of said second sheet each encasing one of said end rails and having its edges bonded to the second sheet at the lower inner edge of each of said end rails, said first sheet extending across the width of the cavity between said side rails and said second sheet extending across the length of the cavity between said end rails, a first flexible, shape-retaining liquid impervious liner of the same shape as the cavity defined by the combination of the side and end rails, said liner having raised sidewalls of a height accommodating liquid containing rectangular cylinders placed therein, said liner having an integral inwardly projecting flange defining its upper edge on all four sides, said liner positioned on the sheets in the cavity defined by the side and end rails, a plurality of liquid retaining rectangular cylinders having rounded edges, each cylinder having a top for adding liquid there to and a closed bottom, the length of each cylinder being such that each fits in the liner extending substantially the length of the cavity between the end rails, each of said cylinders fitted into an individual liquid-impervious tube of substantially the same cross-section as said cylinder, the length of each of said tubes being greater than the length of the cylinders and the ends of said tubes being folded up and over the top of said cylinders, the tube encased cylinders being positioned in horizontal side by side array within the flexible, shape-retaining liquid-impervious liner, the predetermined number of said tube encased cylinders in said liner filling the cavity between the side rails, a second, thin flexible liquid-impervious liner positioned onto and covering the array of cylinders in the first liner, a foam cushion comprising a plurality of sections which in combination compose the length and width of the array of cylinders in the first liner, said foam cushion positioned onto the top of the second thin flexible liquid-impervious liner and a fabric cover encasing the multicomponent core foundation unit, said cover having one-half of a zipper around its perimeter at the lower edge of its sidewall, and b) a detachable pillow top positioned on the top of the cover encased core foundation unit, said pillow top comprising a fabric top sheet, a fabric bottom sheet, a filler contained within said top and bottom sheets, a border around the perimeter of said top cover, said border extending downwardly over the sides of the multi-component core foundation unit and containing the other half of the zipper in the lower edge of the fabric cover for said core foundation.

2. The mattress defined in claim 1 wherein the foam cushion comprises three components, each of said components extending in length across the full width of the mattress core and in width being about one-third of the length of said mattress core, two of the cushion components having a convoluted upper surface, one each of these components being positioned at each end of the mattress core, the third cushion component having a smooth upper surface and positioned between the two components with convoluted upper surfaces.

3. The mattress as defined in claim 1 wherein the foam cushion comprises six components, each of said components extending in length about one-half of the width of the mattress core and in width being about one-third of the length of said mattress core, four of the cushion components having a convoluted upper surface, two each of these components being positioned at each end of the mattress core and two of the cushion components having a smooth upper surface, said smooth upper surface components positioned between the convoluted upper surface components positioned across the top and bottom of said mattress core.

4. The mattress as defined in claim 1 in combination with a planar support platform having a raised edge assembly around its periphery, said mattress positioned on said platform and contained within said raised edge assembly thereby maintaining the shape of the mattress.

* * * * *